US006524436B2

(12) United States Patent
Kettunen et al.

(10) Patent No.: US 6,524,436 B2
(45) Date of Patent: Feb. 25, 2003

(54) FLASH TANK STEAM ECONOMY IMPROVEMENT

(75) Inventors: Auvo K. Kettunen, Neuvoton (FI); Matti Lautala, Karhula (FI)

(73) Assignee: Andritz, Inc., Glens Falls, NY (US)

( * ) Notice: Subject to any disclaimer, the term of this patent is extended or adjusted under 35 U.S.C. 154(b) by 0 days.

(21) Appl. No.: 09/999,483

(22) Filed: Dec. 4, 2001

(65) Prior Publication Data

US 2002/0036069 A1 Mar. 28, 2002

Related U.S. Application Data

(62) Division of application No. 09/587,977, filed on Jun. 6, 2000, now Pat. No. 6,346,166.

(60) Provisional application No. 60/138,775, filed on Jun. 14, 1999, and provisional application No. 60/140,826, filed on Jun. 28, 1999.

(51) Int. Cl.[7] ..... D21C 11/06

(52) U.S. Cl. ..... 162/47; 162/239; 162/240

(58) Field of Search ..... 162/14, 15, 16, 162/29, 47, 239, 240, 250, 251; 60/648; 203/11, 88

(56) References Cited

U.S. PATENT DOCUMENTS 3,763,020 A * 10/1973 Drew et al. ..... 203/14
4,897,157 A * 1/1990 Elmore et al. ..... 162/240
5,637,192 A * 6/1997 Mansour et al. ..... 162/29
6,217,711 B1 * 4/2001 Ryham et al. ..... 203/26

OTHER PUBLICATIONS

Perry, H.R., Chemical Engineer' Handbook, 5th Edition, pp. 6–29 to 6–34.*

"Noncondensible Gases", Burgess, *Chemical Recovery in The Alkaline Pulping Processes,* Third Edition, TAPPI Press, 1992, pp. 37–44.

* cited by examiner

*Primary Examiner*—Dean T. Nguyen
(74) *Attorney, Agent, or Firm*—Nixon & Vanderhye P.C.

(57) ABSTRACT

By the utilization of a jet ejector (such as a thermocompresser) in a cellulose chemical pulp mill, it is possible to effectively increase the utilization of steam. The volume of steam from a flash tank which flashes black liquor from a pulp digester may be increased (e.g. at least about 10%), while the volume and temperature of the liquor discharged from the flash tank are decreased and its concentration increased, by operatively connecting the jet ejector to the steam discharge from a flash tank. The jet ejector is supplied with higher pressure steam from another source which can result in a low pressure or partial vacuum condition in the flash tank. The flash tank may be a single flash tank or one of a series of flash tanks, and an ejector can be associated with at least another flash tank in the series. The hot spent cooking liquor from the digester can be cooled in a heat exchanger (for example in indirect heat exchange relationship with a fresh cooking liquor) prior to introduction in to the flash tank or series of flash tanks. Alternatively a jet ejector may be used to increase the pressure of a low pressure steam flow in a pulp mill to make it suitable for alternative uses.

5 Claims, 8 Drawing Sheets

FLASH TANK STEAM ECONOMY IMPROVEMENT

CROSS-REFERENCE TO RELATED APPLICATION

This application claims the benefit of Provisional Application No. 60/138,775, filed Jun. 14, 1999, and Provisional Application No. 60/140,826, filed Jun. 28, 1999, the entire content of which is hereby incorporated by reference in this application. This application is a division of Application Ser. No. 09/587,977 filed Jun. 6, 2000, the entire content of which is hereby incorporated by reference in this application now U.S. Pat. No. 6,346,166.

This application is based upon provisional application serial Nos. 60/138,775, filed Jun. 14, 1999, and 60/140,826, filed Jun. 28, 1999, the disclosures of which are hereby incorporated by reference herein.

BACKGROUND AND SUMMARY OF THE INVENTION

In the pulp and paper art it is highly desirable to improve the steam economy of the flash tanks utilized (which flash tanks are, for example, shown per se in U.S. Pat. Nos. 5,172,867, 4,551,198, and 5,700,355, the disclosures of which are hereby incorporated by reference herein). It may be possible to get such improved economy by decreasing chip bin or flash tank pressure to be able to get more flash steam from the flash tank. [Though the term "flash tank" is used throughout this discussion and is a term of the art, it is to be understood by those familiar with the art that this term includes any apparatus in which a hot pressurized liquid is exposed to a lower pressure and allowed to evaporate, typically violently, in an enclosed container to produce a source of steam and liquid at a lower temperature and pressure.] Black liquor could be directly flashed for example to a temperature 90° C. instead of 107° C. Then there would not be need for additional cooling of black liquor and also evaporation loading would slightly decrease. For example, the sub-atmospheric pressure in a flash tank could be maintained by a vacuum pump, such as shown in patent publication WO 97/29236.

However, there is a better solution. One can get more flashed steam from a flash tank by using a steam jet ejector. For example in some continuous digesters it is normal to use much low pressure (LP) steam for steaming even in the summer time. By using some LP steam in a steam jet ejector one can produce more flashed steam and the total LP steam consumption would decrease. A steam jet ejector is a very simple device without any moving parts. The lower LP steam consumption utilizing a steam ejector may give hundreds of thousands of dollars of savings per year for continuous digesters. The investment cost of the ejector should be less than 20% of that and there are essentially no additional operating costs.

There are also some other ways to use a steam jet ejector to improve energy efficiency in the digester area. For example LP steam pressure could be increased by medium pressure (MP) steam to be able to use the LP steam in digester heaters or a digester steam phase.

A steam jet ejector (as seen in FIG. 1) is a venturi jet device that uses the energy available in steam to either a) create a vacuum, b) boost the pressure of a gas, or c) a combination of a) and b). Single stage ejectors can be used to create vacuum levels of about 75 torr (1.5 psia), when discharging to atmosphere. Steam ejectors per se in the pulp and paper art are disclosed in U.S. Pat. Nos. 5,139,620 and 4,692,214. In co-pending application 09/195,444 filed on Nov. 18, 1998 [attorney. ref. 10-1268] a jet ejector is used to increase the efficiency of a spent cooking chemical heat recovery system having reboilers.

Black liquor is normally flashed in one or several stages against atmospheric pressure. Flashed steam is typically used to heat and expel air from the chips arriving to the process. This can be done for example in an atmospheric steaming vessel such as a DIAMONDBACK® chip bin (available from Ahistrom Machinery Inc. of Glens Falls, N.Y.), or in a conventional pressurized steaming vessel. Typically flashed steam is not enough to completely steam the chips and fresh low pressure steam is needed to complete steaming. Due to some friction losses and increased boiling point, black liquor temperature is typically about 107° C. after flashing. Before sending the flashed black liquor to an evaporation plant, the black liquor is typically cooled in a heat exchanger by water to temperature of about 90° C.

By using a conventional steam jet ejector (see FIG. 1 herein) to enhance the use of flash steam in an atmospheric steaming vessel, the flash tank pressure could be decreased to a pressure of about 0.5–1.1 bar absolute (abs.) pressure, preferably about 0.7–1.0 bar abs., and the black liquor would then be flashed to a temperature of about 80–102° C., preferably about 90–100° C. This way the total amount of usable flashed steam would increase and the use of valuable fresh steam could be decreased. The "high pressure" steam utilized as a motive fluid of the steam jet ejector could be low pressure fresh steam, or flashed steam at a higher pressure from one or more previous flashing stages, or high pressure fresh steam. Additional benefits are that there is no longer a need to cool the black liquor going to the evaporation plant and the amount of black liquor to be evaporated would be slightly lower.

A steam jet ejector could also be used in other environments in a Kraft (or other chemical pulping) cooking plant:

- Flashed steam pressure could be increased to be able to use it in a pressurized steaming vessel.
- Flash tank pressure could be decreased to get more steam to a flashed steam condenser to produce more hot water.
- Flashed or fresh low pressure steam pressure could be increased by higher pressure steam to be able to use it in the liquor heaters of a continuous digester.
- Flashed or fresh low pressure steam pressure could be increased by higher pressure steam to be able to use it in the steam phase of a continuous digester.
- Low pressure steam pressure could be increased by higher pressure steam to be able to use it in the direct or indirect liquor heaters of a batch digester.

The broadest embodiment of the invention comprises a method of treating hot spent cooking liquor, having a first pressure and a first temperature, using a flash tank, having a high-pressure liquid inlet, a low-pressure liquid outlet, and a steam outlet; and an ejector, having a high-pressure gas inlet, a low-pressure gas inlet, and a gas discharge, to recover energy from the liquor, consisting of or comprising: (a) introducing the hot spent cooking liquor at the first pressure into the high-pressure liquid inlet of the flash tank; (b) exposing the liquor in the flash tank to a second pressure, lower than the first pressure, so that at least some of the liquor evaporates to form steam and a cooler liquid at about the second pressure and at about a second temperature, lower than the first temperature; (c) removing at least some of the steam from the flash tank in a first gaseous stream; (d) introducing the first gaseous stream to the low-pressure inlet of the ejector; (e) introducing a second gaseous stream having a third pressure, greater than the second pressure, to the high-pressure inlet of the ejector; and (f) discharging a third gaseous stream at a fourth pressure, higher than the second pressure, from the discharge outlet of the ejector; and wherein (a)–(f) are practiced so that the second pressure in the flash tank is lower (e.g. by at least about 0.1 bar abs) than the pressure that would be present in the flash tank without the presence of the ejector under otherwise substantially identical conditions. The present invention also includes practicing (a)–(f) so that the second pressure and the second temperature are lower than the pressure and temperature would be in the prior art without the presence of the ejector under otherwise substantially identical conditions.

The method as recited above may further comprise (h) discharging concentrated hot spent cooking liquor from the flash tank at a temperature at least 2° C. lower than would be present without the utilization of the ejector under otherwise substantially identical conditions.

The hot liquor is preferably hot spent extraction liquor removed from a kraft pulping process, for example, a continuous or batch pulping process. The liquor typically has a temperature of between about 100° C. to 180° C., preferably between about 110° and 160° C., that is, about the temperature of the pulping process, and a pressure ranging from about 5 to 15 bar gage (that is, 6 to 16 bar abs.)

The present invention may also further include, prior to (a), (g) cooling the liquor from the first temperature to a third temperature, lower than the first temperature (e.g. by at least about 5° C.). The cooling process (g) is preferably practiced by passing the hot liquor in heat exchange relationship with a process liquid associated with the cooking process, for example, cooking chemical, such as kraft white, green, or black liquor, or dilution liquor or filtrate (for example, cold blow filtrate, washer filtrate or bleach plant filtrate). This cooler liquid typically has a temperature of less than 130° C. and is typically at between about 60 and 120° C., preferably between about 80 and 100° C.

The second pressure in the flash tank is typically less than 4 bar absolute, for example, between about 0.1 to 2 bar abs., preferably between about 0.5 to 1.5 bar abs. The second temperature in the flash tank typically corresponds to the saturation temperature of the gas (typically "dirty" steam) generated by the exposure of the hot liquor to the second pressure. For example, when the second pressure is between about 0.5 to 1.5 bar abs., the second temperature is between about 80 and 110° C. The second gaseous stream, having a third pressure higher than the second pressure, introduced to the high-pressure inlet of the ejector is typically any available gas stream that will induce a lower pressure in the low-pressure inlet of the ejector. This second gaseous stream is preferably any flow of steam that is readily available in the pulp mill having any available third pressure. For example, the second gaseous stream may be "low-pressure steam" in which the third pressure may range from about 3.5 to 4.5 bar gage (that is, about 4.5 to 5.5 bar abs. or about 50 to 65 psig) or "medium-pressure steam" in which the third pressure may range from about 10 to 12 bar page (that is, 11 to 13 bar abs. or about 145 to 175 psig) or even "high pressure steam" in which the third pressure may range from 13 to 100 bar gage (that is, 14 to 101 bar abs. or about 200 to 1500 psig). The temperature of the second gaseous stream may be between about 100° to 250° C., but is typically, between about 140° to 160° C. Though the second gaseous stream is preferably "clean" steam, for example, steam having little or no sulfur compounds, according to the invention, the second gaseous stream may also be "dirty" steam. This steam may also be "fresh" steam.

The fourth pressure of the third gaseous stream discharged from the ejector during (f), which according to the present invention is greater than the second pressure and lower than the third pressure, is typically a function of the magnitude of the second pressure and the third pressure. The fourth pressure may typically vary from about 0.5 to 5 bar abs., but is preferably between about 0.8 to 3 bar abs. This fourth pressure, according to the present invention, is typically about the same as or less than the pressure of the gas stream released from a prior art flash tank without the use of an ejector, although in some circumstances the fourth pressure may also be greater than the pressure of the gas stream released from a prior art flash tank under otherwise substantially identical conditions.

According to the present invention, the use of the ejector to reduce the pressure inside a flash tank and then raise the pressure supplied to other equipment or processes, typically allows the flash evaporation of hot liquors to produce steam having lower temperatures and greater volumes than the prior art. The lower pressure also permits the lowering of the temperature of the cooled liquor sent, for example, to evaporation. For example, the temperature of the steam and liquid in the flash tank according to the present invention may be lowered at least about 2° C., typically at least about 5° C., preferably at least 10° C. compared to the prior art. At the same time, the volume of gas (steam) produced may typically be increased by at least about 10%, preferably at least 20%, sometimes even more than 40% compared to the prior art.

The present invention may further include (h) discharging the cooler liquid formed at (b) from the low-pressure liquid outlet of the flash tank. The liquid discharged from the low-pressure outlet of the flash tank will typically have a temperature about equal to the second temperature and a pressure about equal to the second pressure. The temperature of this cooler liquid may be below 135° C., typically, below 110° C., preferably below 100° C. This liquid is may pass through two or more additional flash tanks, with or without ejectors according to the invention, and is typically forwarded to the recovery process. This cooler liquid may also be returned to the pulping process for treating the cellulose material prior to or during the pulping process.

The present invention also includes a method of treating hot spent cooking liquor having a plurality of flash tanks having one or more ejectors wherein (a) through (f) are practiced in association with one or more of the flash tanks, preferably, with at least the last or final flash tank. The present invention may also include a plurality of flash tanks, one or more jet ejectors, and one or more heat exchangers wherein (a) through (f) are practiced in one or more flash tanks and (g) is practiced at least before the first flash tank.

Another embodiment of this invention comprises a method of treating a first gaseous stream having a first pressure in a pulp mill to produce a second gaseous stream at a second pressure, higher than the first pressure, using a jet ejector having a high-pressure inlet, a low-pressure inlet, and a discharge outlet, consisting or comprising: (a) introducing the first gaseous stream having the first pressure to the high-pressure inlet of the jet ejector; (b) introducing the second gaseous stream to the low-pressure inlet of the jet ejector; and (c) discharging a mixture of the two gaseous streams to form a third gaseous stream which is discharged from the discharge outlet at a third pressure, greater than the second pressure. The first gaseous stream is preferably a medium pressure (MP) or a high-pressure (HP) steam having a pressure greater than 5.0 bar gage, typically greater than 10 bar gage. The second gaseous stream is preferably low-pressure (LP) steam at a pressure of about 2.5 to 5.0 bar gage (that is, about 3.5 to 6 bar abs. or about 35 to 75 psig). The third pressure is a function of the first and second pressures and is typically between about 3 and 10 bar gage, preferably between about 4 and 9 bar gage, most preferably between 5 and 8 bar gage.

A preferred embodiment further includes (d) monitoring the third pressure and controlling the first pressure in response to the monitoring of the third pressure. This is typically practiced using a conventional automated control loop.

The third gaseous stream at the third pressure may be forwarded to other processes in the pulp mill as needed, including, to heat exchangers for heating other fluids, to a steam-phase digester as the source of steam, to a condenser to improve the efficiency of the evaporators, to one or more batch digesters for heating, Another embodiment of the present invention comprises a system for treating hot spent cooking chemical to recover energy comprising: A source of hot spent cooking liquor. A flash tank having a hot liquid inlet operatively connected to the source of hot spent cooking liquor, a cooled liquid outlet, and a steam outlet. A jet ejector having a high-pressure inlet, a low-pressure inlet operatively connected to the steam outlet of the flash tank, and a discharge for mixed steam. A source of pressurized fluid operatively connected to the high-pressure inlet of the jet ejector. And, means for using the mixed steam discharged from the jet ejector operatively connected to the discharge of the jet ejector.

The source of spent cooking chemical is preferably a chemical digestion process as described above. The flash tank is preferably a conventional flash tank as described in the above reference patents and provided by Ahistrom Machinery Inc. of Glens Falls, N.Y. The jet ejector is preferably a conventional ejector or "thermocompressor" which can handle the temperatures, pressures described above. One preferred thermocompressor is a Graham Thermocompressor manufactured by Graham Manufacturing of Batavia, N.Y., though comparable thermocompressors, eductors, or jet ejectors may be used. The thermocompressor is preferably made from steel, preferably stainless steel, for example, 300-series stainless steel or its equivalent.

The source of pressurized fluid is any source typically available in a pulp mill, for example, low-pressure steam, medium-pressure steam, or high-pressure steam as described above. This steam may be "fresh" steam and/or "clean" steam.

The means for using the mixed steam discharged from the jet ejector may be any steam utilization device or process available in the pulp or paper mill. Some preferred uses include for steaming of wood chips and the like in chip bins or steaming vessels; heating in direct or indirect heat exchangers, for example, in cooking circulation associated with a digester; in steam-phase digesters as the source of steam; or the like.

The system may also include means for cooling the hot liquor positioned between the source of hot liquor and the flash tank for cooling the hot liquor prior to introducing it into the flash tank. The cooling means may be one or more direct or indirect heat exchangers, or any other conventional equipment capable of performing the cooling function. One preferred heat exchanger is an Extraction Liquor Cooler provided by Ahistrom Machinery Inc. (though any conventional heat exchanger can be used), which heat exchanger is typically provided with a source of cooling medium, for example, liquors related to the cooking process as described above.

The present invention may also include two or more flash tanks having high-pressure liquid inlets, low-pressure liquid outlets, and steam outlets. A jet ejector may be positioned in one or more of the steam outlets of the flash tanks. In a preferred embodiment, the invention includes a plurality of flash tanks and the jet ejector is positioned in the steam outlet of the last or final flash tank. When a plurality of jet ejectors are used with a plurality of flash tanks one or more sources of steam may be used as the motive fluid in the one or more jet ejectors. For example, medium-pressure steam (e.g. about 12 bar abs.) may be used as the motive fluid in a first ejector and low-pressure steam (e.g. about 4.5 bar abs.) may be used for another second ejector. The mixed higher-pressure steam discharged from the first ejector may be forwarded to means for using the steam (e.g., a digester feed system steaming vessel), and the mixed lower-pressure steam from the second ejector may be forwarded to another means for using the steam (e.g., the chip bin of a digester feed system). The two or more ejectors may be provided with the same source of motive fluid (e.g., medium-pressure steam at 12 bar abs. or low pressure steam at about 5 bar abs.) The steam provided may be "fresh" steam and/or "clean" steam. Also, the steam discharged from the steam outlet of one flash tank may also provide the motive fluid introduced to the high-pressure inlet of one of the one or more jet ejectors. The present invention may also include one or more heat exchangers located upstream of each of the plurality of flash tanks.

It is the primary object of the present invention to enhance the amount of steam produced from flash tanks in a conventional chemical pulping process and/or decrease the amount and temperature of spent cooking liquor discharged from a flash tank, and/or increase the concentration of the black liquor discharged from a flash tank in a chemical pulping system, and/or to increase the pressure of a low pressure steam flow in a pulp mill, all in a simple yet effective manner. This and other objects of the invention will become clear from an inspection of the detailed description of the invention and from the appended claims.

DETAILED DESCRIPTION OF THE DRAWINGS

Figure 1:
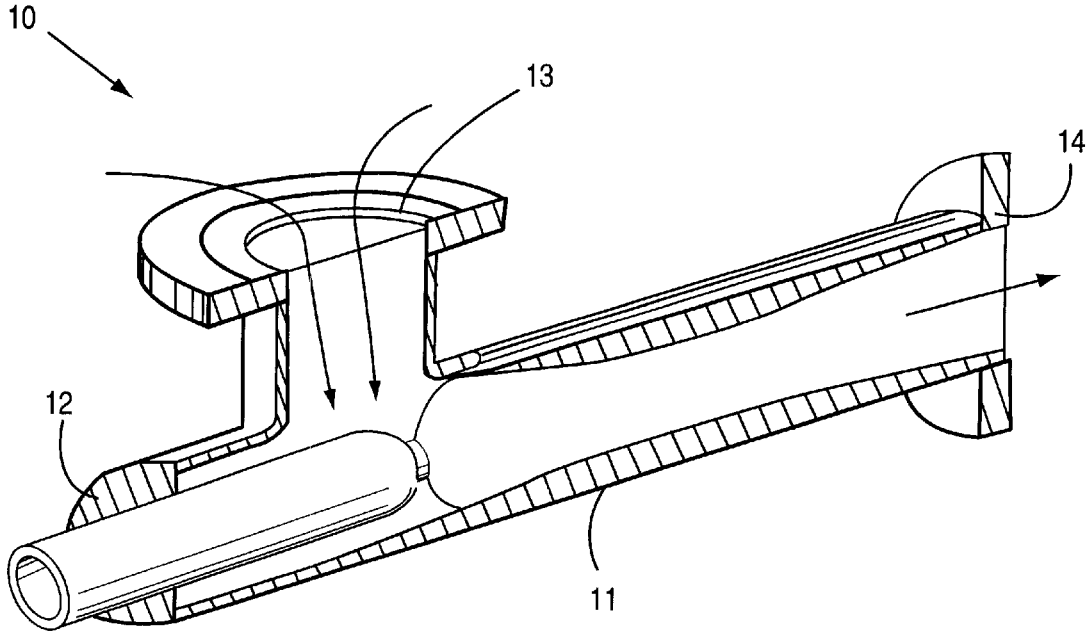
FIG. 1 is a perspective view of a conventional jet ejector that may be utilized according to the present invention, with half of the ejector cut away for clarity of the illustration of the interior thereof.

FIG. 1 illustrates a cross-section of a typical jet ejector that can be used to implementing the present invention. A jet ejector is often also referred to as a "thermocompressor", but the term "ejector" will be used throughout this discussion. The ejector 10 typically comprises or consists of a substantially cylindrical housing 11 having a high-pressure inlet (or motive fluid inlet) 12, a low-pressure inlet (or suction inlet) 13, and a discharge (or mixed fluid outlet) 14. As is typical, the high pressure inlet 12 passes the high pressure fluid (for example, steam) to a venturi nozzle 15 which increases the velocity of the fluid while, due to the principles of Bernoulli, reducing its pressure. The reduced pressure draws the low pressure fluid into the low pressure inlet 13 so that the low pressure fluid is mixed with the high pressure fluid as they pass through the venturi nozzle 15. The mixed fluid of intermediate pressure is discharged from the discharge or outlet 14.

Figure 2:
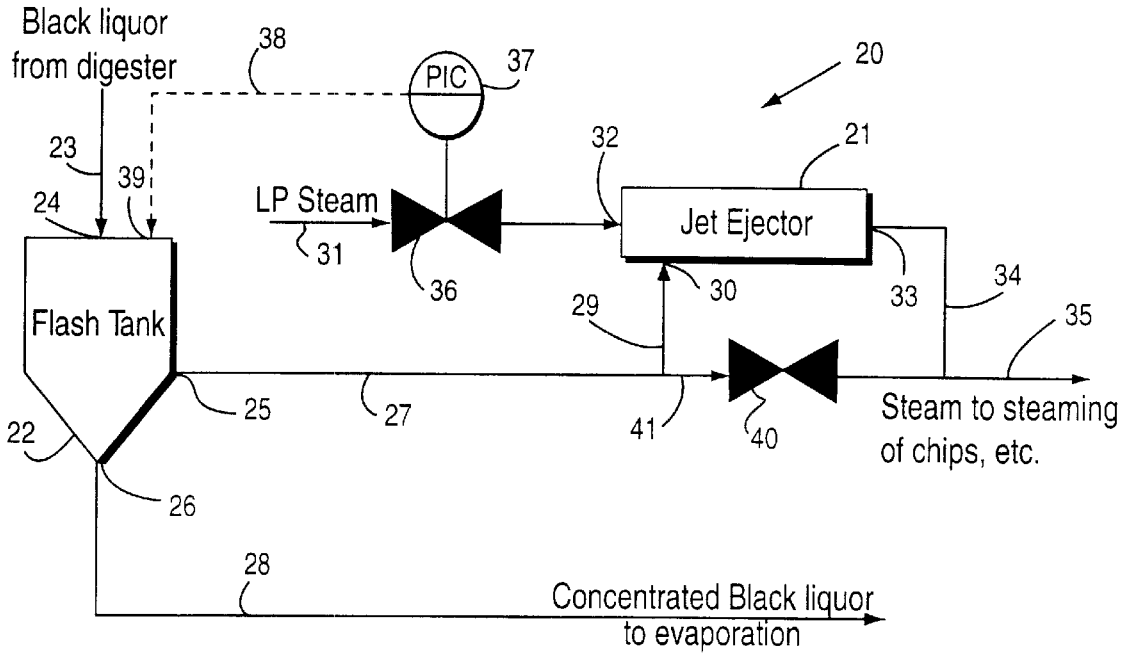
FIG. 2 is a schematic view illustrating an exemplary system according to the present invention to produce a higher volume of flashed steam than in conventional chemical pulping systems, utilizing a jet ejector such as illustrated in FIG. 1.
Figure 3:
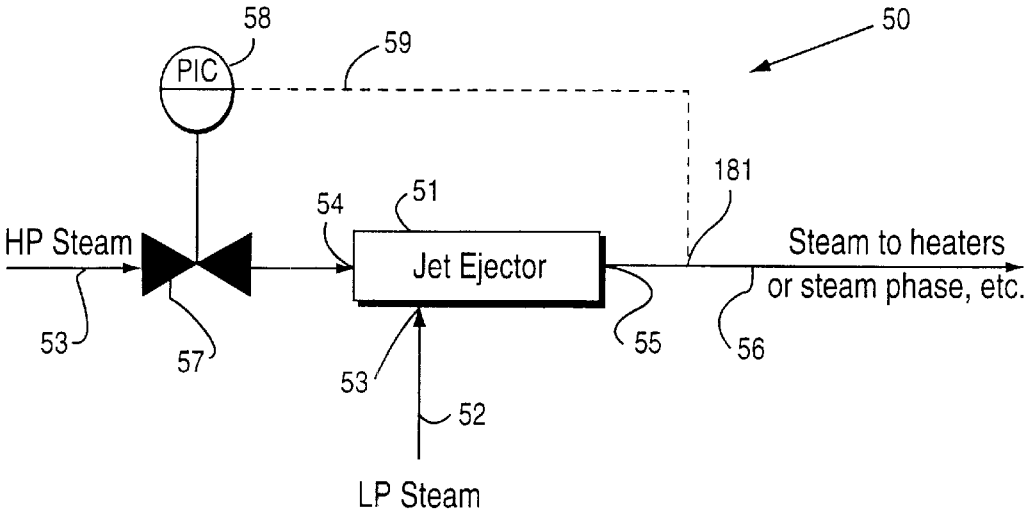
FIG. 3 is a schematic view of a generic system according to the invention for utilizing a steam ejector to increase low pressure steam pressure in a chemical pulping system.

FIGS. 2 and 3 schematically show representative examples how the steam jet ejector of FIG. 1 could be utilized to produce more flashed steam, or increase low pressure (LP) steam pressure, in a chemical pulp mill. FIG. 2 illustrates the simplest embodiment 20 of the present invention in which an ejector 21 is used to increase the output of steam from a conventional flash tank 22. As is conventional, spent cooking liquor 23 containing dissolved products of the pulping reaction and spent cooking chemical is removed from a cooking vessel, or digester, either a continuous or batch digester, and treated to recover energy before regenerating the cooking chemical via recausticization. The spent cooking chemical, or "kraft black liquor" as it is known in the art, typically is pressurized at a pressure ranging from about 5 to 15 bar abs. and at a temperature reflective of the cooking treatment temperature, that is, between about 110 to 180° C. The black liquor 23 may undergo some cooling, for example, by passing it through a heat exchanger prior to being introduced to the flash tank 22.

The flash tank 22 is of substantially conventional construction having an inlet 24 for hot, pressurized black liquor 23, a flashed steam outlet 25, and a cooled, reduced pressure black liquor outlet 26. Flash tanks are typically operated at a pressure lower than the pressure of the black liquor 23 introduced to the flash tank, typically between about 1 to 4 bar abs. Flash tanks are specially-designed vessels which permit the depressurization of hot, pressurized black liquor which causes rapid evaporation (or "flashing") of the liquid, typically water, to steam so that the concentration of the resulting spent cooking chemical and products of the digestion reaction (that is, the "dissolves solids content") of the liquid is increased. The steam produced by this rapid evaporation is discharged from steam outlet 25 into a conduit 27, at the prevailing pressure of the tank 22, for example between about 1 to 4 bar abs., at the saturation temperature corresponding to the prevailing pressure, for example, between about 100° to 140° C. In the conventional art, this steam, which is typically not "clean" steam since it was flashed from "unclean" liquid, is typically forwarded to the feed system of the digester to provide the source of steam for steaming of wood chips to be treated in the digester. The residual liquid remaining after flashing, also typically at a temperature of between about 100° and 140° C., settles to the bottom of the tank 22 and is discharged from outlet 26 into a conduit 28. This residual liquid is typically passed to an evaporator system, with or without passing through one or more further flash tanks, to recover further energy and produce further steam. As disclosed in co-pending application Ser. No. 08/420,730 filed on Apr. 10, 1995 (attorney docket 10-1054), the hot liquor in conduit 27 may also be passed in heat exchange relationship with "clean" water in a reboiler to generate "clean" steam containing little or no sulfur-bearing compounds that can be used elsewhere as needed. Typical flash tank constructions are disclosed in U.S. Pat. Nos. 4,551,198 and 5,669,948.

In the preferred embodiment of the present invention shown in FIG. 2, the steam in conduit 27 is passed via conduit 29 into the low-pressure inlet 30 of jet ejector 21. At the same time steam 31 is introduced to the high-pressure inlet 32 of ejector 21. The two sources of steam are mixed in the ejector 21 and the mixture is discharged from the outlet 33 into conduit 34 at a higher pressure than the pressure of the steam discharged from flash tank 22. The steam in conduit 34 is passed to conduit 35 and used as needed, for example, for the steaming of incoming wood chips. The pressure required in the steam in conduit 35 is typically dictated by the pressure requirements of the eventual use of the steam in conduit 35, for example, for chip steaming. However, according to the present invention, increasing the pressure of the steam in conduit 27 (by using the ejector 21) to the pressure of the steam in conduit 35 (the desired pressure) permits the steam in conduit 27 (that is, the steam produced by the flash tank) to be generated at a lower pressure. Thus, the flash tank 22 may be operated at a lower pressure which, according to the invention, permits the flash tank to produce more 3team while reducing the temperature of the steam and reducing the temperature of the residual spent liquor discharged from the flash tank into conduit 28. Further details of the specific steam temperatures and pressures that can be generated using the invention of FIG. 2 will be discussed below.

As also shown in FIG. 2, the flow of steam, for example, low pressure (LP) steam (though any available steam source may be used), may be regulated by valve 36 which in turn is controlled by a Pressure-indicator-controller (PIC) 37. PIC 37 typically receives a control signal 38 from pressure sensor 39 located on flash tank 22. The pressure of the steam in tank 22 is also typically the pressure of the steam introduced to the low pressure inlet 30 of ejector 21. The flow of steam through valve 36 and to the high-pressure inlet 32 of ejector 21 is regulated depending upon the pressure of the steam introduced to the low pressure inlet 30. As the pressure to the low-pressure inlet 30 decreases, the flow of steam to the high pressure inlet 32 is decreased to maintain a desired pressure in flash tank 22.

The flow of higher pressure steam from conduit 35 to conduit 27 may be regulated by valve 40 in conduit 41. This feedback of high pressure gas to the low-pressure inlet of ejector 21 can sometimes be used to optimize the performance and efficiency of the ejector. Valve 40 may also be opened to bypass the ejector 21. However, valve 40 is typically closed.

FIG. 3 illustrates another embodiment of a system 50 according to the present invention. In this embodiment, a jet ejector 51 is used to raise the pressure of lower pressure gas, typically steam, in conduit 52 with the pressure of a higher pressure gas, again, typically steam, in conduit 53. As shown in FIG. 3, the lower pressure gas (e.g. steam) in conduit 52 (e.g. from a flash tank, or another source) is introduced to the low-pressure inlet 67 of ejector 51 and the higher pressure gas in conduit 53 is introduced to the high-pressure inlet 54 of ejector 51. The resulting gas, again, typically steam, at an intermediate pressure, (having a pressure higher than the pressure of the gas in conduit 52) is discharged from outlet 55 of ejector 51 into conduit 56. The gas in conduit 56 may be used wherever needed in the pulp mill, for example, as a source of steam in a heat exchanger, or as a source of steam for chip steaming, or as a source of steam for steam-phase treatment in a digester, among others.

As shown in FIG. 3, the flow of steam, for example, high-pressure (HP) steam, though any available steam source may be used, may be regulated by valve 57 which may be regulated by a conventional Pressure-indicator-controller (PIC) 58. PIC 58 typically receives a control signal 59 from pressure sensor 181 located on conduit 56. The flow of steam through valve 57 and to the high-pressure inlet 54 of ejector 51 is regulated depending upon the pressure of the steam discharged from the outlet 55. As the pressure in the discharge conduit 56 decreases, the flow of steam to the high pressure inlet 54 is increased to maintain a desired discharge pressure in conduit 56.

Figure 4:
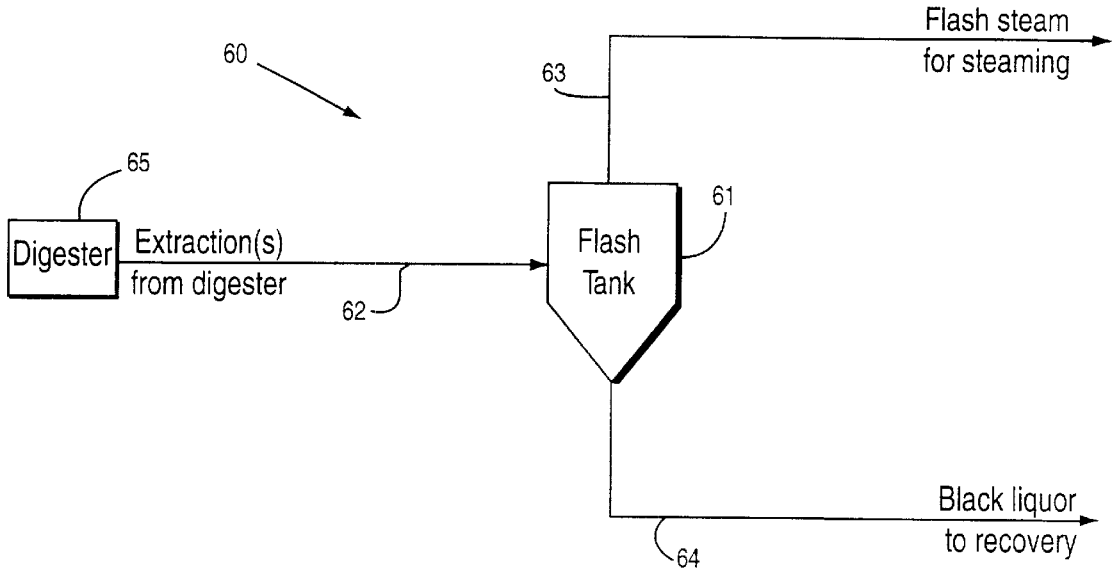
Fig. 4 (Prior Art)
FIGS. 4 and 5 are schematic representations of exemplary prior art flash tank systems in chemical pulping installations.

FIG. 4 is a schematic representation of a typical prior art system 60 having a flash tank 61 used for flashing one or more conventional extractions 62 from a digester 65 at a typical temperature (about 150° C.) to produce more flash steam 63 and black liquor 64 at a lower temperature. For example, the hot, pressurized extraction liquor 62 at a temperature of about 150° C. and a pressure of about 1.5 to 15 bar abs. is introduced to flash tank 61 operated at about 1.2 bar abs. The resulting steam discharged to conduit 63 has a temperature of about 107° C. and a pressure of about 1.2 bar abs. and is forwarded to steaming of wood chips in the feed system of the digester. The resulting cooled, concentrated, black liquor in conduit 64 also has a temperature of about 107° C. and a pressure of about 1.2 bar abs. and is typically forwarded to the black liquor recovery system, typically including evaporators.

Figure 5:
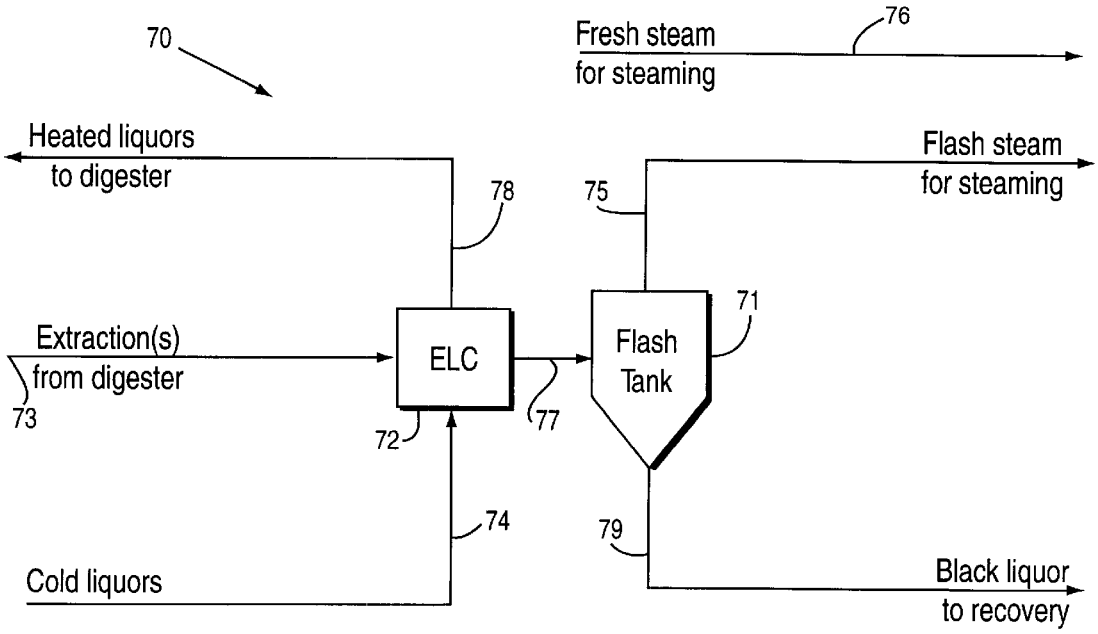
Fig. 5 (Prior Art)

FIG. 5 is a schematic representation of a conventional prior art system 70 having a flash tank 71 like that of FIG. 4 only utilizing a conventional extraction liquor cooler (ELC) 72, which comprises a heat exchanger that reduces the temperature of the extraction in conduit 73 from the digester (such as a continuous kraft digester) while simultaneously heating cool liquids in conduit 74 that are to be supplied to the digester, and also schematically illustrating that the flash steam in conduit 75 for steaming is combined with fresh steam in conduit 76 to steam the chips, or other comminuted cellulosic fibrous material, such as in a steaming vessel or chip bin (not shown). In this case the hot extraction liquor in conduit 73 at about 150° C. and about 1.5 to 20 bar abs. (typically 8 to 16 bar abs.) is cooled by ELC 72 to about 120° C. with little or no loss in pressure and discharged to conduit 77. The cooling medium in conduit 74, typically, cooking chemical, such as kraft white, green, or black liquor, or dilution liquor or filtrate (for example, cold blow filtrate, washer filtrate or bleach plant filtrate) at about 80° C. is heated in the ELC 72 to about 135° C. and discharged to conduit 78. This heated liquid in conduit 78 can be used as needed in the digester, for example, for cooking chemical in a cooking circulation or as dilution in circulation where Lo-Solids® cooking is practiced, as described in U.S. Pat. Nos. 5,489,363; 5,536,366; 5,547,012; 5,575,890; 5,620,562; 5,662,775; 5,824,188; 5,849,150; 5,849,151; and others.

In the prior art embodiment of FIG. 5, the cooler extraction liquor in conduit 77 is flashed in flash tank 71 to produce steam in conduit 75 and cooled liquid in conduit 79 at a pressure of about 1.2 bar and a temperature of about 107° C. The liquor in conduit 79 is forwarded onto recovery, for example, via further flash tanks and evaporators. The flashed steam in conduit 75 is forwarded to chip steaming or other substantially conventional uses. The steam in conduit 75 may typically be supplemented by fresh steam introduced via conduit 76 at a temperature of about 155° C. and a pressure of about 4.5 bar.

Figure 6:
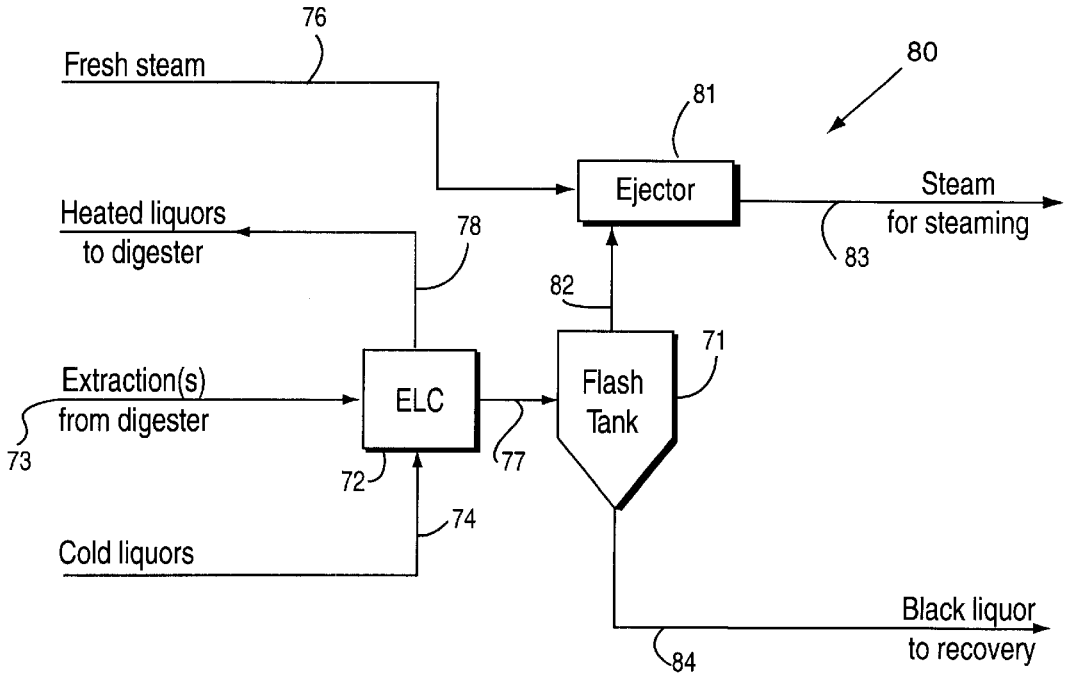
FIG. 6 is a schematic illustration like that of FIG. 5 only showing a system according to the present invention.

FIG. 6 is a schematic illustration of the system 80 similar to the system 70 of FIG. 5 only utilizing a steam ejector 81 according to the present invention to increase the temperature and pressure of the flash steam produced. The system 80 shown in FIG. 6 includes the essentially identical extraction liquor cooler 72, having the same extraction liquor with the same temperature (i.e., about 150° C.) at the same pressure (i.e., about 1.5–10 bar abs.) in conduit 73, the same cooling medium at the same temperature (i.e., about 80° C.) in conduit 74, the same heated liquid at the same temperature (i.e., about 135° C.) in conduit 78, the same cooler black liquor at the same temperature (i.e., about 120° C.) in conduit 77, and essentially the same flash tank 71 shown in FIG. 5. The system of FIG. 6 also includes the same source of fresh steam in conduit 76 as was shown in FIG. 5 having essentially the same temperature (i.e., about 155° C.) and pressure (i.e., about 4.5 bar abs.) as the system shown in FIG. 5.

The system of FIG. 6 is distinct from that of FIG. 5 in that the steam in conduit 76 (which may not be fresh steam, but any source of available steam) is directed to the high pressure inlet of conventional ejector 81 (as in FIG. 1) and the steam outlet from flash tank 71 communicates with the low-pressure inlet of ejector 81 via conduit 82, the steam in conduit 82 for this example at a temperature of about 95° C. and a pressure of about 0.8 bar abs. The mixture of steam discharged from the ejector 81 into conduit 83 has a temperature of about 102° C. and a pressure of about 1.1 bar abs. As a result, the ejector 81 under the motive pressure of the steam in conduit 76 induces a pressure reduction in the low-pressure outlet of ejector 81 such that a vacuum is produced in conduit 82 and in flash tank 71 specifically, a subatmospheric pressure of about 0.8 bar abs. At this lower pressure, that is, lower than the prior art flash tank pressure of about 1.2 bar abs. as shown in FIG. 5, the hot liquor introduced to flash tank 71 via conduit 77 (at about 120° C. and greater than 1.5 bar abs.) flashes to a lower temperature and produces more steam and a cooler liquor in the flash tank 71. In the example shown in FIG. 6, at a pressure of about 0.8 bar abs., the liquor in conduit 77 flashes to about 95° C. and the cooler liquor discharged from the flash tank 71 into conduit 84 is cooled to about 95° C. (compared with the about 107° C. shown in the prior art of FIG. 5). Furthermore, compared to the prior art system shown in FIG. 5, more flashed steam is produced by flash tank 71 in FIG. 6 than flash tank 71 in FIG. 5, typically, at least about 10% more steam, possibly as much as about 20–40% more steam. As a result, the present invention using the same source of black liquor 73 and the same supply of steam 76 produces more steam in conduit 83 and cooler liquor in conduit 84 than the prior art.

Figure 7:
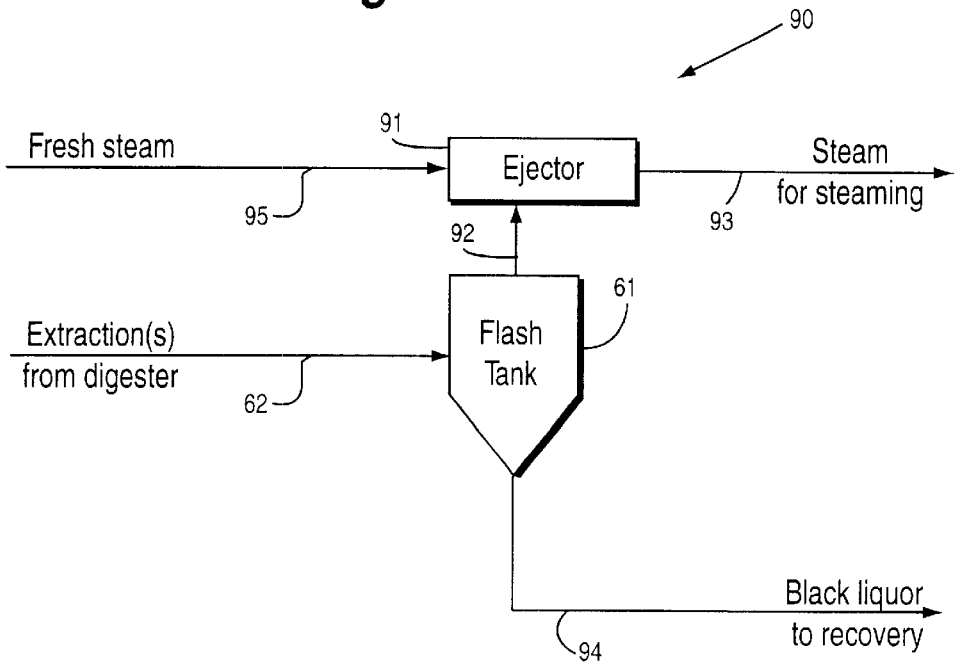
FIG. 7 is a view like that of FIG. 4 only showing a system according to the present invention.

FIG. 7 is a view like that of FIG. 4 only showing a system 90 using a steam ejector 91 to decrease the temperature and pressure of the flashed steam in conduit 92.

The system 90 of FIG. 7 of the present invention does not include an ELC 72 as shown in FIG. 6. The flash tank 61 of the system 90 in FIG. 7 receives an essentially identical supply of hot extraction liquor from a digester in conduit 62 at essentially the same temperature (i.e., about 150° C.) and pressure (i.e., 8–15 bar abs.) as the flash tank 61 of FIG. 4. However, according to the present invention, the steam discharge conduit 92 of FIG. 4 communicates directly with the low-pressure inlet of jet ejector 91. The high-pressure inlet of ejector 91 also receives a supply of higher pressure steam via conduit 95 at about 155° C. and about 4.5 bar abs. The mixture of gases is discharged from the ejector 91 to conduit 93 at a temperature of about 103° C. and a pressure of about 1.1 bar abs. Similar to the system shown in FIG. 6, the ejector 91 of FIG. 7 produces a pressure in conduit 92 and in flash tank 61 of about 1.0 bar abs. (that is, a pressure lower than the about 1.2 bar abs. of the prior art system shown in FIG. 4). As a result, the hot liquor in conduit 62 introduced to flash tank 61 flashes to produce more steam at a temperature of about 102° C. (in conduit 92) and the resulting cooler liquor discharged from the flash tank 61 via conduit 94 has a lower temperature of 102° C. (that is, again, lower than the 107° C. temperature of the liquid produced in conduit 64 if the prior art system shown in FIG. 4). Again, clearly, even without an extraction liquor cooler (ELC), the present invention produces more steam and a cooler liquor than the prior art.

Figure 8:
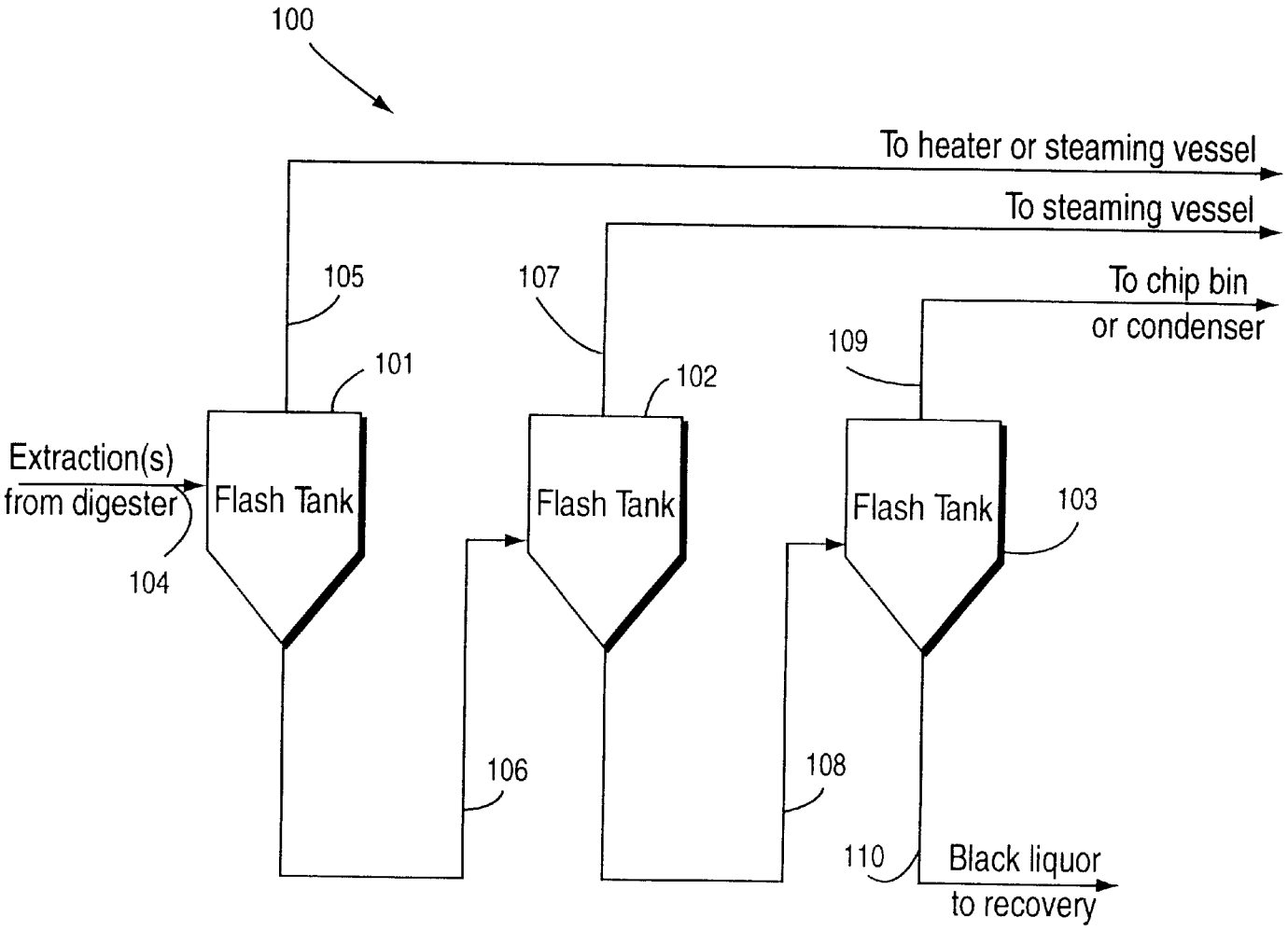
Fig. 8 (Prior Art)
FIG. 8 is a schematic illustration of a conventional prior art system utilizing a plurality of series-connected flash tanks in association with an extraction from a cellulose pulp digester.

FIG. 8 is a schematic view of an exemplary prior art system 100 where a plurality of flash tanks 101, 102, 103 are used in association with the extraction from a digester in conduit 104 (e.g. at a temperature of about 160°). As is typical of the prior art, FIG. 8 illustrates a step-wise progression of pressure relief and steam generation. For example, for the system shown, hot extraction liquor in conduit 104 from a digester is first expanded at 3.5 bar abs. in flash tank 101 to produce steam in conduit 105 at about 140° C. and about 3.5 bar abs. and liquor in conduit 106 at about 140° C. The steam in conduit 105 is used where needed, for example, in a heat exchanger for heating a liquid or to the steam treatment of chips. The cooler liquor in conduit 106 is forwarded to flash tank 102 where it is again flashed but to a pressure of 2.4 bar abs. This produces a steam flow in conduit 107 at about 128° C. and about 2.4 bar and a liquor flow in conduit 108 at about 128° C. and about 2.4 bar. Again, the steam in conduit 107 is used as needed, for example, for the steaming of wood chips in a steaming vessel. The cooler liquor in conduit 108 is again flashed but to a pressure of about 1.2 bar and a temperature of about 107° C. in flash tank 103, those conditions prevailing in conduit 109. The steam in conduit 109 is again used and forwarded as needed, for example, to chip steaming in a chip bin or steaming vessel, or passed to a steam condenser for recovery of the condensate. The coolest liquor in conduit 110, unless flashed further, is forwarded to the black liquor recovery operation. As a result, the system of FIG. 8 produces three sources of steam (in conduits 105, 107, 109) at varying pressure and a cooler liquor (in conduit 110) at about 107° C. from an initial supply of spent cooking liquor (in conduit 104) at about 160° C.

Figure 9:
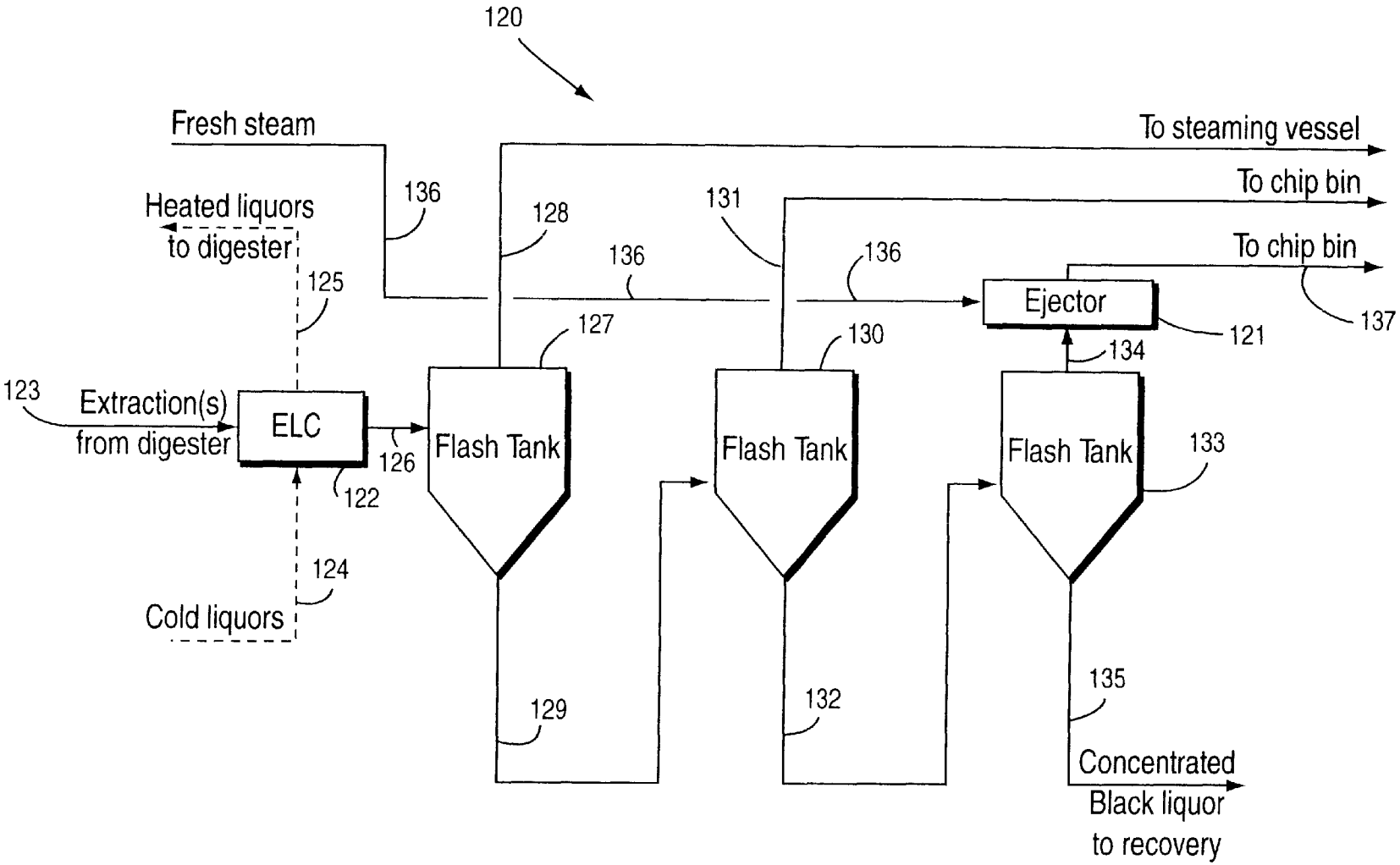
FIGS. 9 and 10 are schematic illustrations like that of FIG. 8 only showing two alternative systems according to the present invention.

FIG. 9 is a schematic illustration of a system 120 like the system 100 of FIG. 8 but having a jet ejector 121 and utilizing an extraction liquor cooler (ELC, an indirect heat exchanger) 122 before the extraction liquor in conduit 123 from the digester is flashed, and utilizing the steam ejector 121 to increase the temperature and pressure of the flash steam from the last (133) of the series of flash tanks. In the embodiment shown in FIG. 9, the spent digester extraction liquor in conduit 123, at about 160° C. and a pressure of between about 1.5 to 10 bar abs., is optionally first passed in indirect heat-exchange relationship in ELC 122 with a cooler (e.g. about 80° C.) liquid in conduit 124 to produce a heated liquid in conduit 125. The cooler liquid in conduit 124 is typically cooking chemical, such as kraft white, green, or black liquor, or dilution liquor or filtrate (for example, cold blow filtrate, washer filtrate or bleach plant filtrate) at about 80° C. This cooler liquid in conduit 124 is heated in the ELC 122 to about 140° C. and discharged to conduit 125. The heated liquid in conduit 125 can be used as needed in the pulp mill, for example, for cooking chemical in a cooking circulation or as dilution in a circulation where Lo-Solids® cooking is practiced, as described in the U.S. patents listed above. The cooled extraction liquid is discharged from ELC 122 with little or no pressure loss to conduit 126 at a temperature of about 135° C.

The liquid in conduit 126 is introduced to the first flash tank 127 which, in the embodiment shown, operates at a pressure of about 2.4 bar abs. The resulting flashed steam in conduit 128 and cooled liquor in conduit 129 have a temperature of about 128° C. The steam in conduit 128 (at a pressure of about 2.4 bar abs) may be used as needed in the pulp mill, for example, for steaming wood chips in a steaming vessel or chip bin or for heating other fluids. The liquid in conduit 129 is forwarded to the second flash tank 130, which, in this embodiment, operates at about 1.2 bar abs. and produces steam in conduit 131 and liquid in conduit 132 at about 107° C. The steam in conduit 131 (at a pressure of about 1.2 bar abs) may be used as needed in the pulp mill, for example, for steaming wood chips in a steaming vessel or chip bin or for heating other fluids. The liquid in conduit 132 is forwarded to the third (and in this embodiment last) flash tank 133.

According to the present invention, flash tank 133 is operated at a reduced pressure and temperature, for example, 0.7 bar abs. and 92° C., since the steam outlet of flash tank 133 communicates with the low-pressure steam inlet of ejector 121 via conduit 134. The steam in conduit 134 is also at about 92° C. and 0.7 bar. Jet ejector 121 receives its motive fluid via conduit 136. In the embodiment shown, the motive fluid in line 136 is fresh steam at about 155° C. and about 4.5 bar, though other sources of steam may be used, including "unclean" steam. The steam mixed in ejector 121 is discharged at a temperature of about 102° C. and a pressure of about 1.1 bar abs. into conduit 137. The liquor discharged from flash tank 133 to conduit 135 is also at a temperature of about 92° C. Thus, compared to the prior art system 100 shown in FIG. 8, the system 120 of the present invention shown in FIG. 9 produces more steam at a lower temperature and pressure in conduit 137 and less (and more concentrated) liquor at a cooler temperature in conduit 135.

Figure 10:
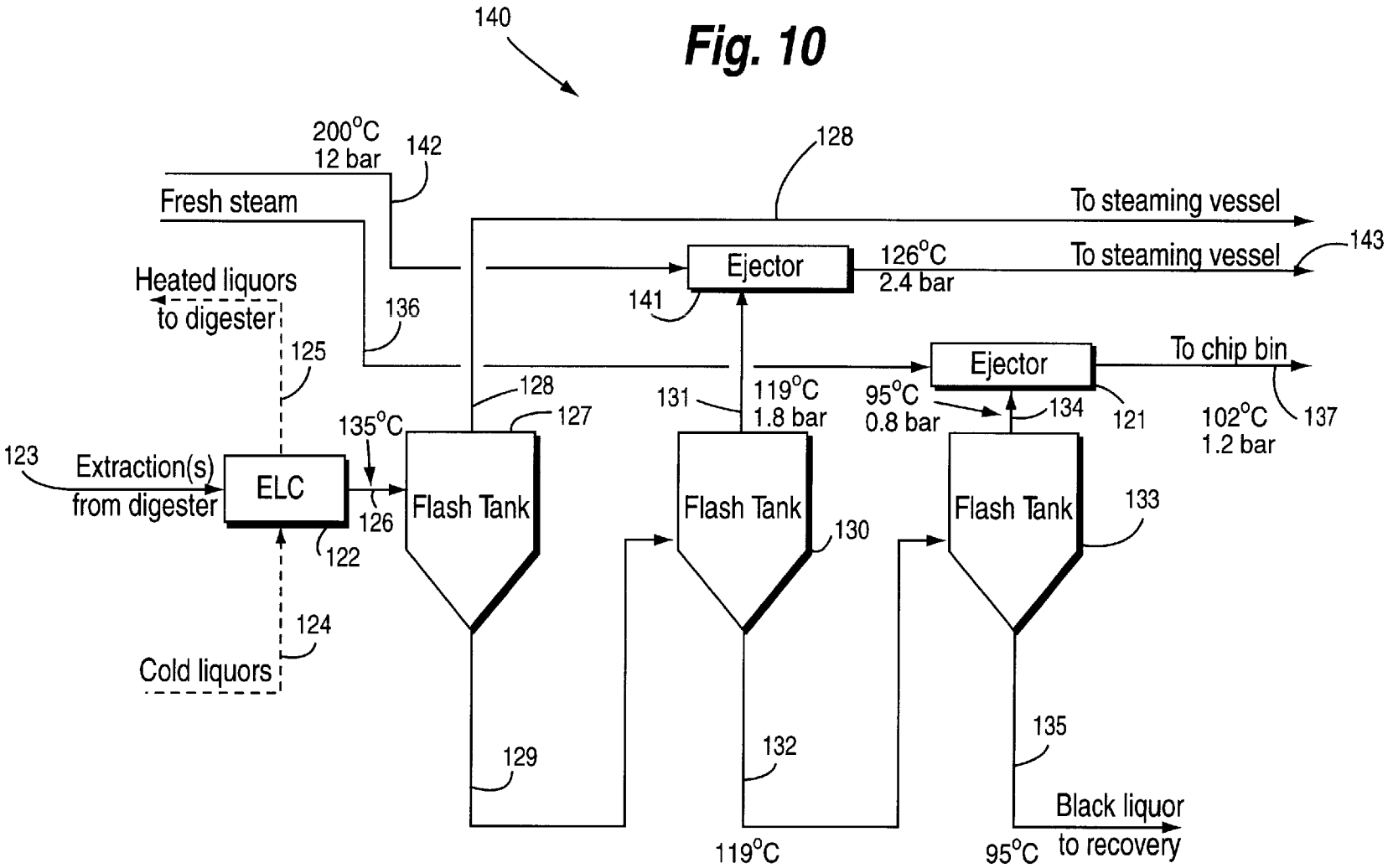

FIG. 10 is a schematic illustration of an embodiment 140 like that of FIG. 9 only utilizing a steam ejector 141 for the second flash tank 130 also. Since most of the structures shown in FIG. 10 are identical to those shown in FIG. 9, the same identifying reference numbers are used in FIG. 10 as were used in FIG. 9. Where the temperatures or pressures differ from those in FIG. 9, they are shown.

Figure 11:
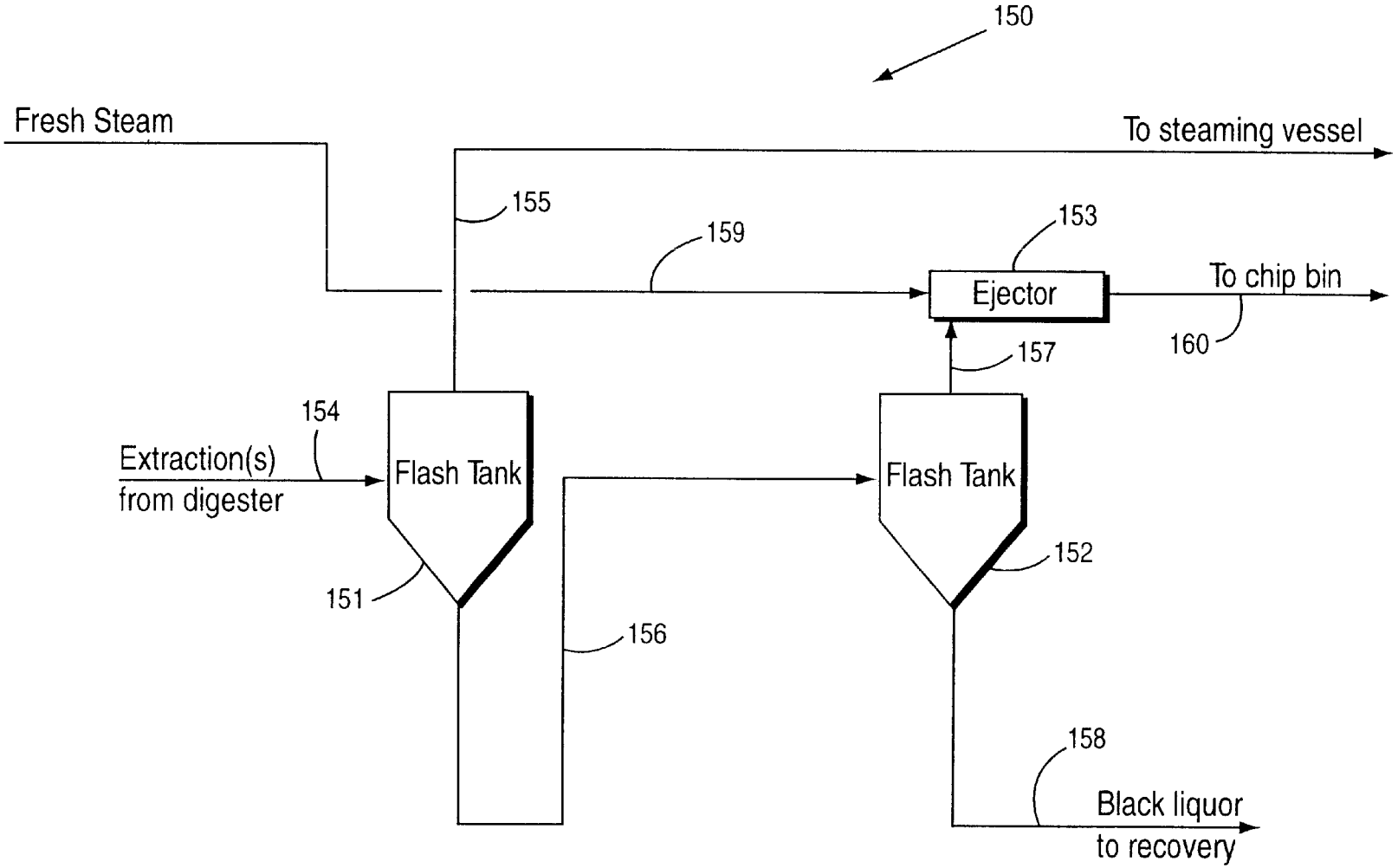
FIG. 11 is a side schematic view of another exemplary flash tank system according to the present invention.

FIG. 11 is a schematic illustration of another embodiment 150 according to the invention in which two flash tanks are used and an ejector 153 is associated with the second flash tank 152. System 150 includes a first flash tank 151, a second flash tank 152 and a jet ejector 153. Similar to the earlier embodiments, a stream of hot digester extraction liquor (e.g., at about 160° C.) is introduced to the high-pressure liquid inlet of flash tank 151 via conduit 154. (A cooling heat exchanger may be located in this conduit as described above.) In this embodiment, flash tank 151 is operated at a pressure of about 2.4 bar abs. and a temperature of about 128° C. As a result, the hot black liquor in conduit 154 flashes to produce steam at about this temperature and pressure in line 155, and a cooler liquor at about this temperature and pressure in line 156. The steam generated is discharged from the steam outlet of flash tank 151 into conduit 155. The steam in conduit 155 is forwarded to, for example, a steaming vessel to steam chips prior to digestion. The cooled liquor in flash tank 151 is discharged from the low-pressure liquor outlet into conduit 156.

The liquor in conduit 156, at about 2.4 bar abs. and about 128° C., is forwarded to the high-pressure inlet of the second flash tank 152. Flash tank 152 is operated at a pressure of about 0.9 bar and a temperature of about 98° C. Again, according to this invention, flash tank 152 can operate at this subatmospheric pressure due to the vacuum created by ejector 153 operatively connected thereto. The steam flashed from the liquor in conduit 156 is discharged from flash tank 152 via conduit 157 and is drawn into the low-pressure inlet of ejector 153. The cooled black liquor in flash tank 152 is discharged from the low-pressure outlet into conduit 158. Though the liquor in conduit 158 (at about 98° C.) may be treated further, for example, further flashing or cooling, the liquor in conduit 158 is preferably forwarded to the evaporators of the black liquor recovery system.

The steam in conduit 157 at about 0.9 bar abs and about 98° C. is mixed in ejector 153 with higher pressure steam supplied to the high-pressure inlet of ejector 153 via conduit 159. In the embodiment shown the higher pressure steam in conduit 159 is "low-pressure" fresh steam having a pressure of about 4.5 bar abs. and a temperature of about 155° C. The mixed gases are discharged from the ejector 153 at a pressure of about 1.1 bar (again, greater than the pressure in conduit 157) and about 102° C. into conduit 160. In this embodiment, the steam in conduit 160 is forwarded to a chip bin for steaming wood chips or the like, though the steam in conduit 160 may be used in other conventional ways, for example, in a heat exchanger.

The present inventions illustrated in FIGS. 6,7, 9–11 may typically include automatic controls such as the P-I-C controller 37 shown in FIG. 2.

It is to be understood that in the above description the temperatures are indicated as approximate, and that there typically will be a range of at least 4–5° C. above or below each of the temperatures, and that the pressures are also approximate and there will typically be a range of at least 0.2 bar abs±the pressures indicated, and that the invention contemplates all narrower ranges within these broad ranges. The invention is particularly suited for the situation where an extraction liquor cooler is utilized with a digester, enhancing the economics of the use of a jet steam ejector. Flash tank pressure increased by a jet steam ejector is most beneficial when the total amount of flash steam is small but when it is necessary to use a large amount of steam for steaming.

For all of the ranges given in the application, all smaller ranges within the broad range are specifically provided. For example, and example only, a temperature of 60–100 degrees means 75–90, 88–91, 60–93, and all other smaller ranges within the broad range.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims. The invention is to be accorded the broadest w interpretation possible consistent with the prior art.

What is claimed is:

1. A system for treating hot spent cooking chemical to recover energy comprising:

at least one flash tank having a hot liquid inlet operatively connected to the source of hot spent cooking liquor, a cooled liquid outlet, and a steam outlet;

at least one jet ejector having a high-pressure inlet, a low-pressure inlet operatively connected to said steam outlet of said flash tank, and a discharge for mixed steam;

a source of pressurized fluid operatively connected to said high-pressure inlet of said jet ejector; and means for using the mixed steam discharged from said jet ejector operatively connected to said discharge of said jet ejector.

2. A system as recited in claim 1 wherein said at least one flash tank comprises a first flash tank, and a second flash tank, said second flash tank operatively connected to said jet ejector; and wherein said first flash tank has a cooled liquid outlet operatively connected to said hot liquid inlet of said second flash tank.

3. A system as recited in claim 1 wherein said at least one flash tank comprises a first flash tank, a second flash tank, and a third flash tank, and wherein said at least one jet ejector comprises a first jet ejector; and wherein said first flash tank has a cooled liquid outlet operatively connected to the hot liquid inlet of said second flash tank, and wherein said second flash tank has a cooled liquid outlet operatively connected to said hot liquid inlet of said third flash tank, and wherein said third flash tank is operatively connected to said first jet ejector.

4. A system as recited in claim 3 wherein said at least one ejector comprises first and second ejectors, and wherein said third flash tank is operatively connected to said first jet ejector, and said second flash tank is operatively connected to said second jet ejector.

5. A system as recited in claim 1 further comprising a heat exchanger operatively connected between said source of hot spent cooking liquor and said flash tank hot liquid inlet so as to cool the hot spent cooking liquor before introduction into said hot liquid inlet.

* * * * *

US006524436C1

(12) EX PARTE REEXAMINATION CERTIFICATE (5560th)

United States Patent

Kettunen et al.

(10) Number: US 6,524,436 C1

(45) Certificate Issued: Oct. 10, 2006

(54) FLASH TANK STEAM ECONOMY IMPROVEMENT

(75) Inventors: Auvo K. Kettunen, Neuvoton (FI); Matti Lautala, Karhula (FI)

(73) Assignee: Andritz Inc., Glens Falls, NY (US)

Reexamination Request:
No. 90/006,869, Nov. 17, 2003

Reexamination Certificate for:

| | |
|---|---|
| Patent No.: | **6,524,436** |
| Issued: | **Feb. 25, 2003** |
| Appl. No.: | **09/999,483** |
| Filed: | **Dec. 4, 2001** |

Related U.S. Application Data

(62) Division of application No. 09/587,977, filed on Jun. 6, 2000, now Pat. No. 6,346,166.

(60) Provisional application No. 60/138,775, filed on Jun. 14, 1999, and provisional application No. 60/140,826, filed on Jun. 28, 1999.

(51) Int. Cl.
*D21C 11/06* (2006.01)

(52) U.S. Cl. ..... 162/47; 162/239; 162/240

(58) Field of Classification Search ..... 162/14, 162/15, 16, 29, 47, 57, 65, 68, 239, 240, 162/250, 251
See application file for complete search history.

(56) References Cited

U.S. PATENT DOCUMENTS

| | | | |
|---|---|---|---|
| 4,755,258 | A | 7/1988 | Ryham |
| 5,628,623 | A | 5/1997 | Skaggs |
| 5,690,786 | A | 11/1997 | Cirucci |
| 6,179,958 | B1 | 1/2001 | Lysen |

*Primary Examiner*—Eric Hug

(57) ABSTRACT

By the utilization of a jet ejector (such as a thermocompresser) in a cellulose chemical pulp mill, it is possible to effectively increase the utilization of steam. The volume of steam from a flash tank which flashes black liquor from a pulp digester may be increased (e.g. at least about 10%), while the volume and temperature of the liquor discharged from the flash tank are decreased and its concentration increased, by operatively connecting the jet ejector to the steam discharge from a flash tank. The jet ejector is supplied with higher pressure steam from another source which can result in a low pressure or partial vacuum condition in the flash tank. The flash tank may be a single flash tank or one of a series of flash tanks, and an ejector can be associated with at least another flash tank in the series. The hot spent cooking liquor from the digester can be cooled in a heat exchanger (for example in indirect heat exchange relationship with a fresh cooking liquor) prior to introduction in to the flash tank or series of flash tanks. Alternatively a jet ejector may be used to increase the pressure of a low pressure steam flow in a pulp mill to make it suitable for alternative uses.

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–5 are cancelled.

* * * * *